US005099814A

United States Patent [19]

Ament

[11] Patent Number: 5,099,814

[45] Date of Patent: Mar. 31, 1992

[54] FUEL DISTRIBUTING AND INJECTOR PUMP WITH ELECTRONIC CONTROL

[75] Inventor: Frank Ament, Troy, Mich.

[73] Assignee: General Motors Corporation, Detroit, Mich.

[21] Appl. No.: 439,295

[22] Filed: Nov. 20, 1989

[51] Int. Cl.[5] ..... F02M 37/00

[52] U.S. Cl. ..... 123/450; 123/458; 123/419; 417/462

[58] Field of Search ..... 123/450, 458, 500, 501, 123/419, 436; 417/462

[56] References Cited

U.S. PATENT DOCUMENTS

| | | | |
|---|---|---|---|
| 3,598,507 | 8/1971 | Voit | 123/450 |
| 4,180,037 | 12/1979 | Hobo | 123/450 |
| 4,357,662 | 11/1982 | Schira | 123/419 |
| 4,453,896 | 6/1984 | Vilardo | 123/450 |
| 4,509,477 | 4/1985 | Takao | 123/419 |
| 4,539,956 | 9/1985 | Hengel | 123/357 |
| 4,598,683 | 7/1986 | Ohmori | 123/450 |
| 4,604,980 | 8/1986 | Leblanc | 123/450 |
| 4,625,694 | 12/1986 | Adey | 123/450 |
| 4,660,522 | 4/1987 | Babitzka | 123/450 |
| 4,862,853 | 9/1989 | Tsukamoto | 123/419 |
| 4,884,549 | 12/1989 | Kelly | 123/450 |
| 4,936,277 | 6/1990 | Deutsch | 123/436 |

OTHER PUBLICATIONS

Hess, T., "DM Pump for Rugged Applications", Brochure on Roosa Master pump from Stanadyne, Sep. 10–13, 1979.

*Primary Examiner*—Carl Stuart Miller

*Attorney, Agent, or Firm*—Karl F. Barr, Jr.

[57] ABSTRACT

A fuel injection system with precisioned cylinder to cylinder fuel control with computer controls for a normally closed solenoid fuel inlet control valve to a fuel distributor pump which features rapid response fuel cut off to terminate and precisely control and vary fuel pulse width to the separate cylinders of an internal combustion engine as computed to optimize engine operation for improved cylinder torque balance, idle speed control, cylinder cut out, and fuel control for improved particulate regeneration. In this system the solenoid valve is opened before the rotor inlet fuel ports hydraulically communicate to reduce solenoid pull in response and repeatably requirements while assuring fuel fill between the solenoid valve and rotor fill ports.

4 Claims, 3 Drawing Sheets

FUEL DISTRIBUTING AND INJECTOR PUMP WITH ELECTRONIC CONTROL

TECHNICAL FIELD

This invention relates to fuel injection for internal combustion engines and more particularly to a new and improved fuel injection control system with electronically controlled inlet metering valving to precisely terminate the flow and control the quantity of fuel delivered to each firing cylinder for optimizing engine operation.

BACKGROUND OF THE INVENTION

Prior to the present invention, various controls have been provided to meter fuel to an injection pump which delivers pressure waves of fuel to the separate cylinders of an internal combustion engine such as for powering a vehicle. In co-pending patent application Ser. No. 393,183 filed Aug. 14, 1989, in the names of M. A. Mitchell and D. P. Sczomak and hereby incorporated by reference, a metering valve is disclosed with a variable fuel restriction mechanically controlled by an engine governor that supplies varying amounts of fuel per unit time in accordance with engine speed so that fuel flow to the pump and cylinders is determined by the particular position of the metering valve and not by the rotor and rotor sleeve communication ports or windows in the injection pump. Such construction requires mechanical linkage between the governor and metering valve that is unable to cut off and tailor amounts of fuel to each separate cylinder in accordance with their varying requirements for optimized engine operation.

To provide improved control over the fuel supplied to each cylinder and, as disclosed in U.S. Pat. No. 4,539,956 issued Sept. 10, 1985 in the names of J. F. Hengel, D. J. Armstrong, F. Ament, M. B. Center and J. E. Ausen and hereby incorporated by reference, a solenoid valve has been utilized in parallel and in series with a governor controlled metering valve. While that construction provided for improved cylinder to cylinder fuel control, a governor controlled metering valve was still utilized and the solenoid arrangement was additive to provide the control at the start of the fuel flow into the fuel delivery ports provided in the distributor pump of this unit.

The present invention is of the general category of that of U.S. Pat. No. 4,539,956 but provides a straightforward and simplified construction and entirely eliminates the governor controlled metering valve system. The present invention utilizes an electronically controlled inlet metering solenoid for improving the cylinder to cylinder injection of pressure waves of fuel into the various cylinders of the engine which are metered in varying widths in accordance with requirements so that each cylinder will produce a predetermined torque such as an equalized torque for each cylinder.

It is a feature, object and advantage of this invention to provide a new and improved electronic fuel control which rapidly cuts off the flow of fuel that is being delivered to the distributor or delivery pump while the fuel ports to the pumping elements are in registry to control the quantity of fuel that will be delivered to the injector nozzles and cylinders. With variable end of the fluid flow through the rotor sleeve communicating with the port areas there is precise control over the amounts of fuel delivered to each of the cylinders so that the torque output of the cylinders can be equalized or adjusted to provide the torque output desired. When a sufficient quantity of fuel for each pumping event is delivered to the delivery pump, the solenoid valve quickly closes under the action of an associated closure spring to provide a precise cutoff of the pressure fuel input to the pump and delivery valve with the cutoff being adjusted to occur when the ports are in registry. The effective metering and pulse width control is accomplished in the inlet port area and with the cutoff providing the precisioned fuel metering control. Accordingly, with the present invention, there is improved cylinder to cylinder fuel control such as for improved idle, soot control, smooth engine operation and engine efficiency.

These and other features, objects and advantages of this invention will be more apparent from the following detailed description and drawings in which:

DETAILED DESCRIPTION OF THE DRAWINGS

Figure 1:
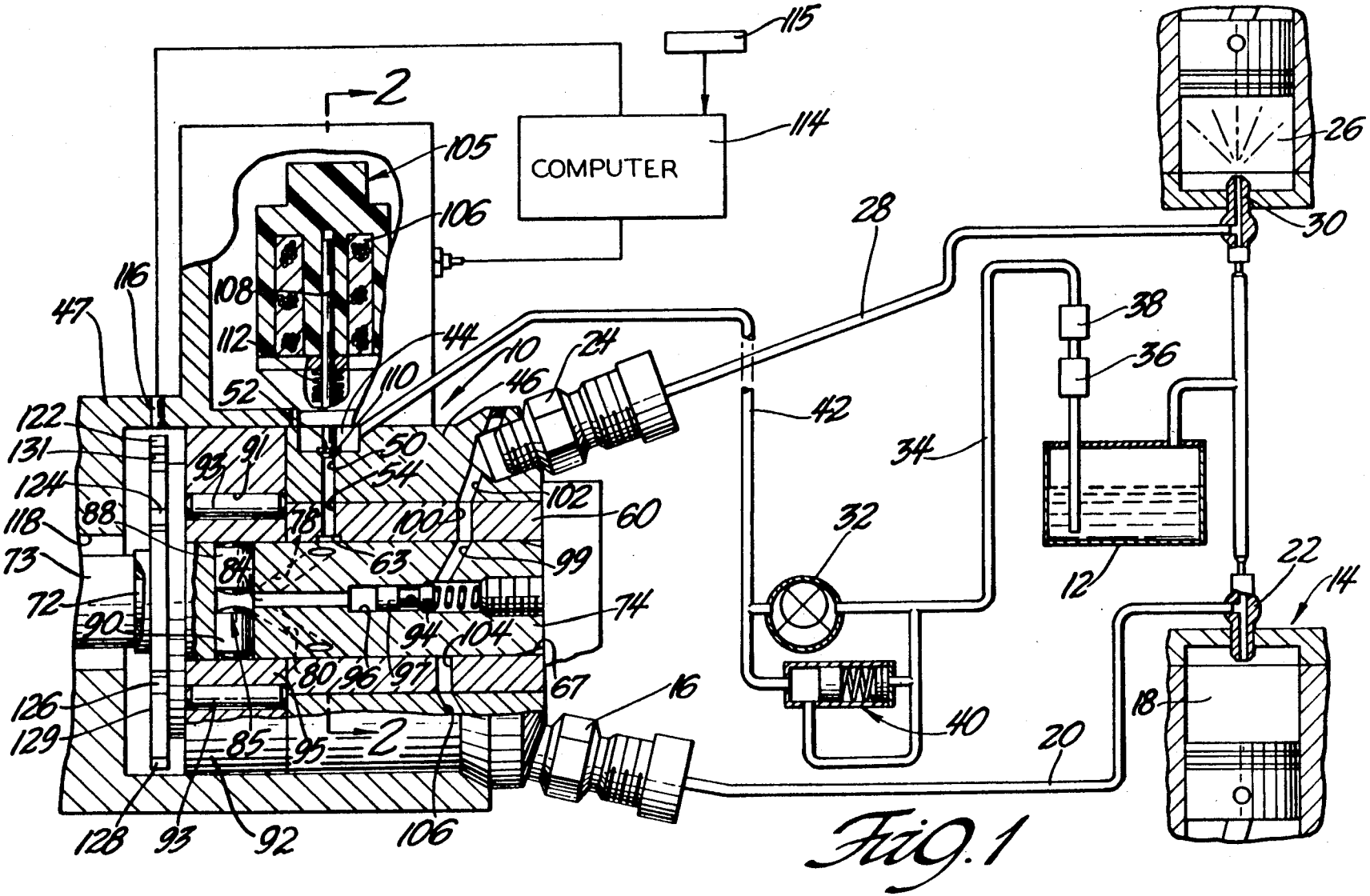
FIG. 1 is a schematic diagram of a portion of a fuel flow system for a distributor pump for a fuel injected, internal combustion engine.

Turning now in greater detail to the drawings, there is shown in FIG. 1 a hydraulic head assembly 10 of a distributor pump for pumping and distributing pressure waves of liquid fuel from a tank 12 to the combustion chambers of the cylinders of an internal combustion engine 14. This engine may have eight or any appropriate number of cylinders for power requirements but only two are shown for purposes of illustrating the principles of this invention.

Accordingly, the head assembly 10 is shown with a discharge fitting 16 feeding combustion chamber 18 through a high pressure fuel injection line 20 and nozzle 22 and with a second discharge fitting 24 feeding a second combustion chamber 26 through high pressure line 28 and nozzle 30.

Figure 2:
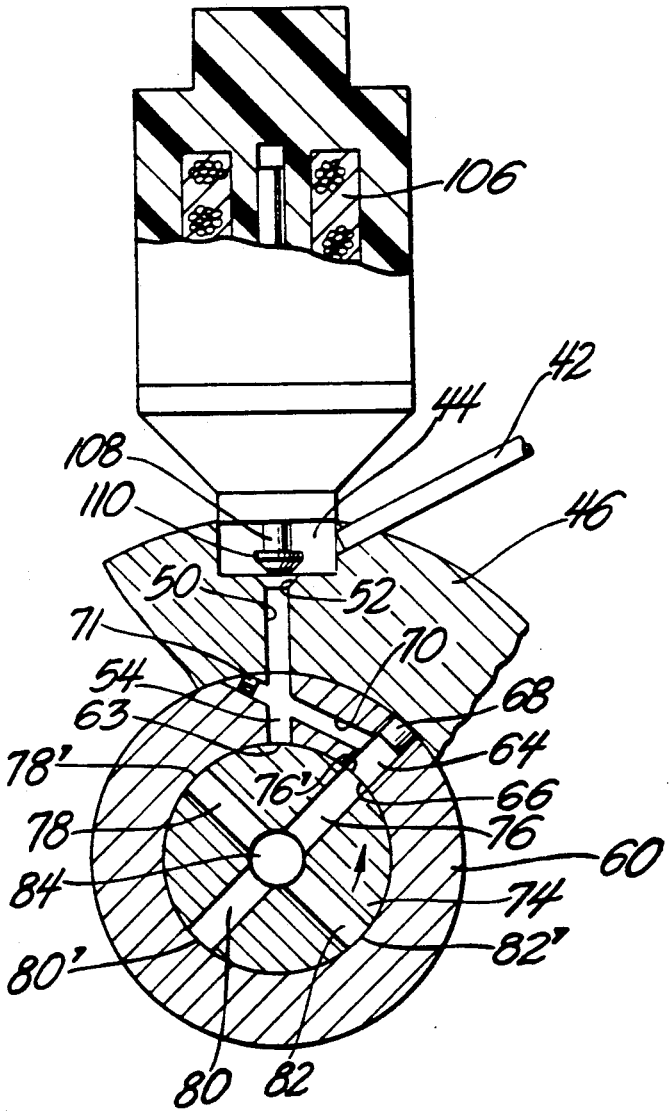
FIG. 2 is a cross-sectional view of a fuel pump rotor and housing taken generally along lines 2—2 of FIG. 1 but showing a solenoid valve element in a retracted position.
Figure 3:
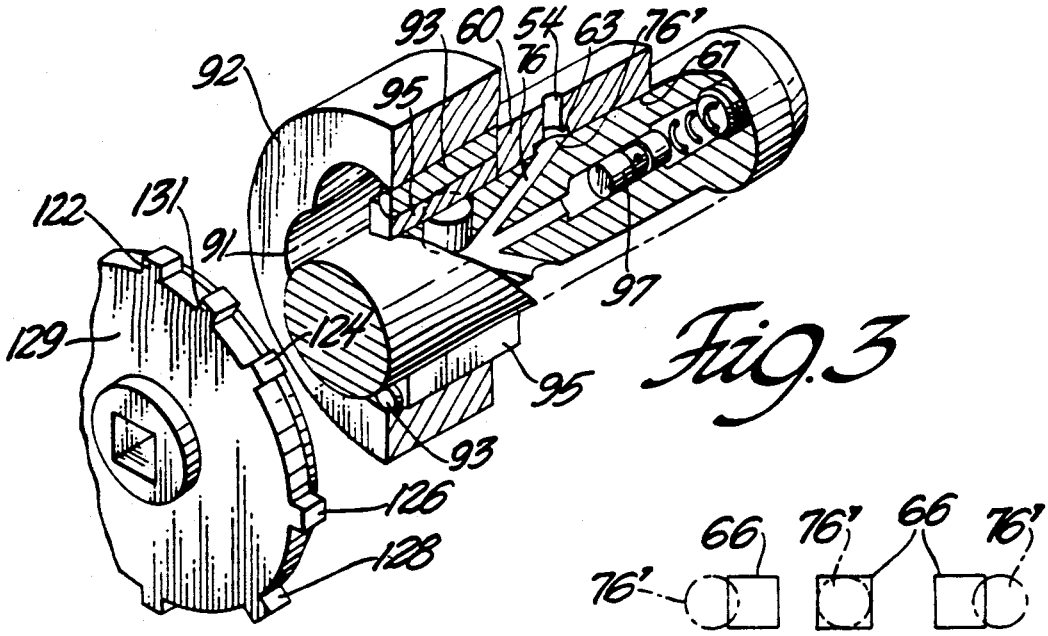
FIG. 3 is an exploded view of portions of the distributor pump of FIGS. 3.

The head assembly 10 includes a vane type transfer pump 32 driven by the engine 14 that pumps fuel at low pressure from the liquid fuel tank 12 through line 34 usually having water separator 36 and fuel filter 38 operatively mounted therein. The output volume and pressure of pump 32 is controlled by a pressure regulator valve 40 hydraulically connected in parallel therewith. The transfer pump has its output connected to a passage or transfer line 42 that feeds pressure fuel into a low volume, closed end fuel receiving or storage chamber 44 (see FIG. 2) formed in a cylindrical outer body 46 of the distributor pump head assembly 10. The body 46 is fixed to a casing or support structure 47. The fuel chamber 44 has a radial and inwardly extending fuel feed passage 50 extending from a valve seat 52 in the bottom wall of the chamber 44 and terminating in an outlet that connects into a continuation feed passage 54 bored through the wall of a cylindrical sleeve 60. Feed passage 54 terminates in a fixed fuel feed port 63 as shown in FIGS. 1 through 3. The fuel feed port 63 is rectilinear in configuration, but may be circular or have other configurations. As shown in FIG. 2, there is, in addition to feed passage 54 in sleeve 60, a second radial feed passage 64 drilled through the wall thereof at a predetermined location clockwise from passage 54. This second feed passage 64 terminates in a second fixed feed port 66 in the inner cylindrical wall 67 of the sleeve 60. Fuel feed port 66 has the same configuration as feed port 63. The feed passages 50, 54 and 64 and interconnecting cross bore 70 provide minimum volume fuel storage downstream of the solenoid control valve later described. For an eight cylinder engine the second passage 64 and feed port 66 is located at 45' from passage 54 and feed port 63. The outer end of passage 64 is blocked by plug 68. The cross bore 70 inclined in the wall of the sleeve 60 hydraulically interconnects the two fuel feed passages 54 and 64. A plug 71 blocks the outer end of cross bore 70.

Mounted for rotation in the inner cylindrical opening provided by sleeve 60 and interfacing with wall 67 thereof is a cylindrical fuel distributing rotor 74. The outer end of this rotor is drivingly connected at 72 to a drive shaft 73 that is driven at half engine speed by the engine. The rotor 74 has four radial fuel feed passages 76, 78, 80 and 82 spaced at ninety degree intervals and each respectively extends inwardly from an associated circular feed port 76', 78', 80' and 82' to a central passage which forms a fuel pumping chamber 84 for the high pressure pump 85.

As shown, the pump 85 is within the head assembly 10 and comprises a pair of pumping plungers 88 and 90 operatively mounted for stroking movement in rotor 74. These plungers are stroked inwardly on the rotational drive of rotor 74 by the inner camming surfaces 91 of annular fixed cam 92 which contacts the rollers 93 of opposing cam shoes 95, the inner surfaces of which contact the outer ends of the plungers. The high pressure pump 85 is operative to pump high pressure waves of fuel from the pumping chamber 84 into a delivery valve assembly 94 operatively mounted for shifting movement in a cylindrical axial bore 96 in the rotor that hydraulically communicates with the pumping chamber 84.

The delivery valve assembly incorporates an axially shiftable spring-loaded valve element 97 mounted in bore 96 to function as a one-way check valve to seal the pumping chamber 84 from the fuel injection lines and to provide a fuel retraction device after an injection event to an associated combustion chamber.

At the beginning of pumping the cam pushes the plungers inward, and the delivery valve is fuel pressure shifted until fuel flow from pumping chamber 84 is fed to a radial discharge passage 99 in the rotor that turns and sequentially communicates with separate fuel feed passages in the sleeve 60 and body 46 which lead to the various discharge fittings and to the high pressure lines and associated combustion chambers.

For example, FIG. 1 shows discharge passage 99 hydraulically communicating with feed passages 100 and 102 in the sleeve 60 and body 46 to feed a pressure wave of fuel to combustion chamber 26 through fitting 24 and high pressure line 28. After the injection event, the continually turning rotor sequentially feeds pressure waves of fuel to other combustion chambers in the same manner. When the rotor is rotated 180 degrees from that shown, for example, the exit port of discharge passage 99 will communicate with the feed passages 104 and 106 in sleeve 68 and housing 46 to feed a pressure wave of fuel to combustion chamber 18 through discharge fitting 16, line 20 and nozzle 22.

Importantly in this invention, there is precisioned metering of the supply of fuel to the high pressure pump elements 85 and the delivery valve for optimizing the operation of the engine including smoothing engine idle, reducing exhaust smoke, balancing torque output and improving fuel efficiency. This is accomplished by precisely tailoring the fuel delivery requirements for each cylinder to produce the desired and optimized engine operation by cutting off the end of the pulse wave of fuel being fed to the pumping chamber at appropriate computer controlled measurements for quantitative delivery of fuel to each cylinder.

The preferred embodiment of this invention has a fuel inlet metering valve assembly 105 with a solenoid 106 housed within casing 47 and operatively mounting in the body 46 to form the upper limits of the storage chamber 44. A solenoid operated valve element 108 has a valve head 110 at its lower end that is normally biased by a spring 112 acting on the valve element to move the head into fuel sealing engagement with its valve seat 52 to terminate the flow of fuel under pressure from the transfer pump to the feed passage 50 and thus to the high pressure pump 85 to thereby control the amount of fuel delivered thereto.

The solenoid valve element 108 is shifted to its open position illustrated in FIG. 2 by electrical energization of the solenoid assembly 106 through the control of a computer 114 that receives vehicle torque demands from the vehicle operator through control 115 and is fed signals from a magnetic reluctance pick up 116 mounted in an end portion of the wall defining bore 118 in casing 47. The signals are generated by a toothed wheel mounted to the back of the rotor which is rotatably driven at speeds proportional to engine speeds such as ½ engine speed. Pump speed signals are generated by teeth such as teeth 122, 124, 126 and 128 of a wheel 129 secured to the rotor 74 for rotation therewith, each of which corresponds to a particular cylinder in the engine 14. As these teeth serially pass magnetic pick up 116 they provide a porting reference for timing the supply of fuel to the rotor prior to port registry and the cut off of fuel at computed positions of the fuel feed ports during registry. An eight cylinder engine preferably has a rotor wheel with eight precisely spaced teeth so that the computer 114 can precisely determine the engine timing and the angular acceleration of the engine output by the teeth generating signals in the pickup 116. The computer accordingly puts out a series of pulses that control the solenoid and its valve to increase, decrease or maintain the amount of fuel metered for each separate injection event. An additional tooth 131 on the wheel, spaced half way between two of the eight teeth, is used to identify a given cylinder such as #1. This is required for fuel balancing of the cylinders.

Figure 4:
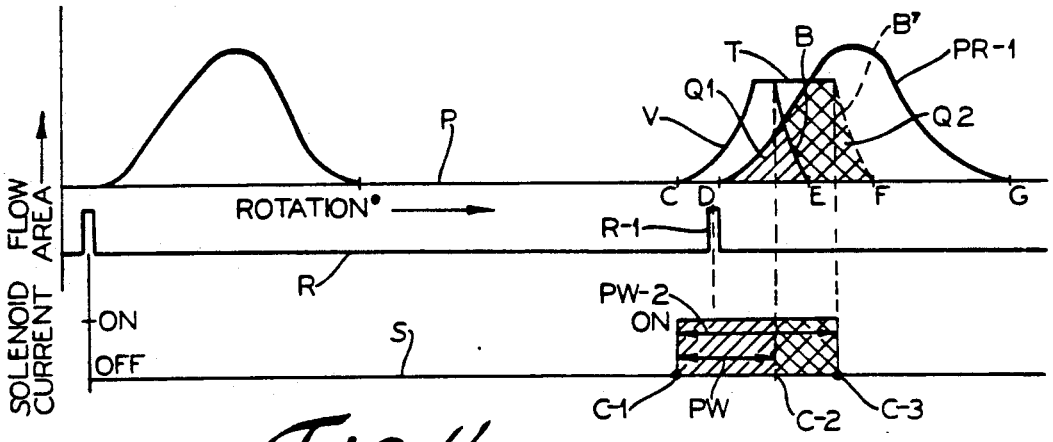
FIGS. 4 and 5 are diagrams illustrating operation of this invention.
Figure 5:
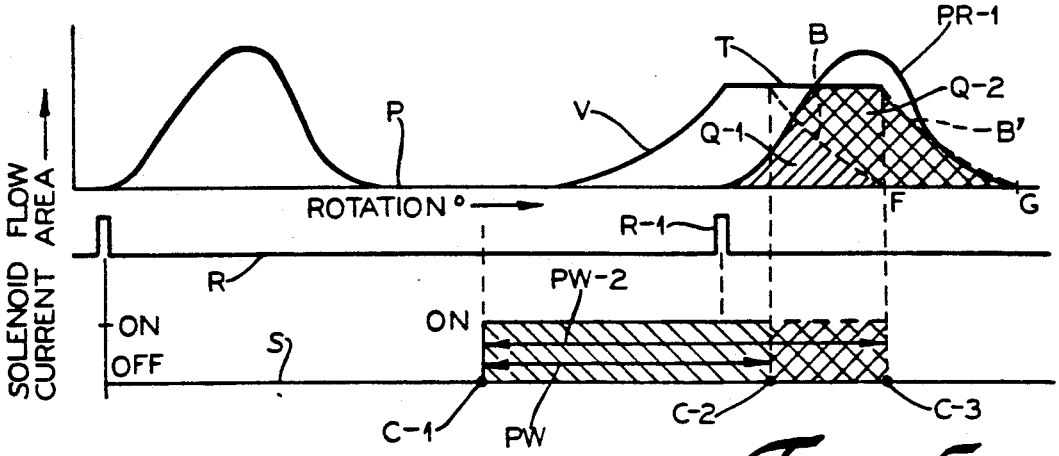

This fuel metering action is illustrated in the diagrams of FIGS. 4 and 5 for one cylinder of an eight cylinder engine operating at 1,000 rpm and 4000 rpm respectively and with precise metered feed to the pumping chamber 84 beginning every 45 degrees of rotation of rotor 74.

Referring in particular to the 1000 rpm engine operation of FIG. 4, the solenoid current and timing curve S shows the solenoid as initially deenergized up to point C-1. Under such conditions, the solenoid spring 112 holds the valve head 110 against the seat 52 so that no fuel in chamber 44 can be pumped by the transfer pump into the fuel feed passage 50. The computer 114 picks up a signal from the magnetic reluctance pick up sensor 116 as any one of the cylinder teeth, 122 for example, approaches the sensor. This is shown as port reference R-1 on porting reference curve R. As the tooth approaches the pickup at point C-1 on the timing curve S, the computer energizes the solenoid 106 so that the solenoid valve 108 is pulled in or retracted to open the valve seat 52. As illustrated by port registry curve P, pressurized fuel is available before any of the precisely spaced ports 76', 78', 80', 82' in rotor 74 are moved into registry with either of the fixed feed ports 63 or 66 in the sleeve 60. This solenoid valve action is shown by curve V as it is pulled from the closure point C to its upper limit illustrated by top line T. After this fuel availability from the opening of the solenoid valve, the ports in rotor 74, port 76' for example, turn nineteen degrees of registry across the fixed rectilinear port 66 in sleeve 60. During this nineteen degrees of rotor rotation and port registry shown on the port registry curve line from D to G, the turning rotor port 76' moves across the first fixed port 66 in sleeve 60. This is diagrammatically shown in the upper part of FIG. 4 by the circle representing moving rotor port 76' transiting across the square representing the fixed port 66. Without fuel inlet control, the fuel feed area to the pumping chamber would be represented by the entire area under the port registry curve PR1. However, the computer with a low torque demand input from the vehicle operator and with the rotational speed of the approaching tooth calculated, computes that only a much smaller volume of fuel is required for light load power output of the associated engine cylinder. The computer accordingly terminates solenoid current at point C-2 on the solenoid current line S. This termination of solenoid current occurs before the port registry is fully completed. For example, a port registry of 6° computed by the computer. The solenoid valve spring 112 resultantly closes the solenoid valve by stroking it to the fuel closure position. This closure action is shown by the backside B of the solenoid curve and extends from the top line T to the point E on the port registry curve P. After 6° port registry, the solenoid valve has seated and no additional fuel is pumped or supplied to the pumping chamber 84. The crossed hatched area Q1 under the port registry curve PR1 represents the quantity of fuel supplied for the pumping event when port registry is completed after the 19° of rotation during port registry. Pumping to the appropriate cylinder occurs after filling port registry terminates at point G.

After point G, 26° will pass before feed port 63 registers with port 76' for example. The time required for this registration provides a fuel prefill time for the second cylinder as the injection event for the first cylinder occurs. With the end of fuel feed precisely controlled by the solenoid valve, the fuel pulse width PW is predetermined by the computer for optimized part load engine operation. After port registry is terminated at point G, the pumping plungers are stroked inwardly by the cam to pump the measured quantity of fuel to the associated engine cylinder for the powered output of that cylinder.

FIG. 4 also illustrates operation of the fuel control when the vehicle operator has required increased power demand from the engine operating at 1000 rpm such as for vehicle acceleration. For such increased power demand, the computer 114 responds by opening the normally closed solenoid valve again at point C-1 and well prior to the registry of the port 76' with the fixed port 66 for example. Since more fuel is required for increased output, the solenoid valve remains open for a longer time period as shown by the solenoid energization curve S which terminates at point C-3. With a longer solenoid energization, there is increased opening time of the solenoid valve for fuel feed through the registering ports 76' and 63. The computer determines the increased quantity or pulse width PW-2 of fuel necessary for the full load and terminates the supply of the current to the solenoid at point C-3. With the fuel supply terminated, the solenoid valve spring 112 quickly closes the solenoid valve so that the inlet fuel is appropriately cut off and metered for full load operation. The increased quantity of fuel or pulse width for full load operation at 1000 rpm is represented by the double crossed hatched area Q2 under curve PR-1 in addition to the single crossed hatched area Q1. The closure motion of the solenoid valve for full load metering is represented by curve B' from top line T to point F of the port registry curve P.

As the rotor continues to rotate, the other ports 82', 80' and 78' will serially move through registry with either port 63 or 66 in the same manner with one registry for each cylinder and with precise fuel cut off and control over the amount of fuel delivered to each of these cylinders in accordance with power demands.

The location of the magnetic pulse, R-1, from the toothed-wheel is chosen to be near the beginning of the rotor port registry (D in FIG. 4) to provide "precise" control of the solenoid turn-off (C-2 and C-3). The solenoid turn-on time (C-1) is not critical with this concept so it is "coarsely" calculated from the port reference point R-1 of the previous cylinder.

The diagram of FIG. 5 is similar to that of FIG. 4 and the operation is basically the same as described in FIG. 4. Accordingly, the reference letters of FIG. 4 apply and are used in FIG. 5. In FIG. 5, engine speed is increased to 4,000 rpm and pump speed to 12°/ms. The FIG. 5 diagram shows that the solenoid 106 is energized at a point C-1 well before the port registry occurs so that pressure fuel is available before the supply ports begin registration. As in the lower speed operation, the single crossed-hatched area Q1 under the curve PR1, as determined by the shortened pulse width PW, represents the quantity of fuel available for part load operation. Area Q-1 in FIG. 5 plus the double crossed-hatched area Q-2 under curve PR1 represents the flow quantity of fuel available for the full load operation at high engine speed. Because of the high pump angular rate at high rpm full load operation, almost the entire area under the port registry curve is used for fuel feed with the spring biased closure stroke shown by curve B'.

The fuel injection system of this invention accordingly provides precisioned cylinder to cylinder fuel control for full and part loads at varying engine speeds. The computer controls a normally closed solenoid fuel inlet control valve to control the feed of fuel to the distributor pump. With rapid response fuel cut off as determined by the computer to provide cylinder torque balance and idle speed control, cylinder cut out, fuel control for particulate regeneration for optimum exhaust gas recirculation and for transmission shift dynamics. By having the solenoid valve opened for fuel availability before the rotor inlet fuel ports hydraulically communicate with the housing fuel port, reliance on solenoid pull in response and response repeatability is eliminated while assuring fuel fill between the solenoid valve and rotor fill ports.

While the invention has been described with reference to particular embodiments disclosed herein, it is not confined to the details set forth. For example, the fuel feed ports 66 and 76' are shown as being rectilinear and circular in shape. However, other shapes such as slots or ovals are possible to vary the available porting areas to provide construction to modify the shape of the port registry curve PR-1 to further control fuel metering to the combustion chambers. In any event, it is apparent that these and various other modifications can be made by those skilled in the art without departing from the scope of the invention set forth in the following claims in which exclusive property or privilege is defined and is as follows.

I claim:

1. A pump for metering and injecting pulses of fuel from a source of pressure fuel into separate combustion chambers of an internal combustion engine comprising a pump housing, a fuel distributing rotor operatively mounted for rotation in said housing, a fuel pumping chamber in said rotor, power means for rotatably driving said rotor, fuel entrance port and associate passage means in said rotor for transmitting fuel from said pressure source to said pumping chamber, pumping means associated with said rotor for pumping fuel supplied thereto to said combustion chambers, fuel passage and associated terminal port means in said housing for supplying fuel from said source to said rotor, said entrance port means and said terminal port means interfacing with one another through a predetermined turning arc of said rotor with respect to said housing for the hydraulic connection of said passage means in said housing to said passage means in said rotor, and electronically controlled valve means movable to an open position for feeding fuel to said passage means in said housing prior to registry of said port means of said rotor and said housing so that said port means have pressurized fuel when registering with one another and for subsequently moving to a closed position prior to the movement of said openings from registry with one another to thereby terminate and control the amount of fuel supplied to each of said combustion chambers.

2. A pump for metering and injecting pulses of fuel from a source sequentially into separate combustion chambers of an internal combustion engine comprising a pump housing, a fuel distributing rotor operatively mounted for rotation within said housing, a fuel pumping chamber in said rotor, power means for rotatably driving said rotor, a storage chamber in said housing for receiving fuel under pressure from said source, fuel entrance port and associated passage means in said rotor for transmitting fuel to said pumping chamber therein, pumping means associated with said rotor and responding to rotation of said rotor for pumping fuel supplied to said pumping chamber to said combustion chambers, fuel passage and associated terminal port means in said housing for transmitting fuel from said storage chamber to said rotor, said fuel passage and terminal port means and said entrance port means registering with one another through a predetermined turning arc of said rotor within said housing for the hydraulic connection of said passage means in said housing to said passage means in said rotor, and electronically controlled valve means for opening said storage chamber in said housing to said passage means in said housing prior to registry of said port means of said rotor and said housing, establishing the availability of pressurized fuel when initially registering with one another, and for subsequently closing said chamber with respect to said associated passage prior to the movement of said openings from registry to terminate and thereby control the amount of fuel supplied to each of said combustion chambers.

3. A fuel injection pump for pumping pulses of pressure fuel of varying widths and volumes from a source sequentially into the combustion chambers of separate cylinders of an internal combustion engine each having a mechanical power output comprising piston means therein so that the output of each of said piston means can be varied and the output of said engine controlled, a pump housing having a cylindrical wall means defining an opening therein, a fuel passage extending through said pump housing, said fuel passage having an outer entrance defining a valve seat and an inner exit defining outlet port means, a fuel distributor rotor mounted for rotation in said opening for sequentially distributing fuel to said combustion chambers of said cylinders, rotor porting means moving through a registry with said outlet port means in which the fuel flows through said housing and into said rotor for distribution to said combustion chambers of said cylinders, and valve means associated with said housing and having a shiftable valve element operably moveable to a first position with respect to said valve seat to initiate the supply of pressure fuel to said rotor prior to the registry of said outlet port means with said rotor porting means, said valve element being biased to a second position to terminate the supply of fuel to said rotor during the registry of said outlet port means with said rotor porting means and at varying points of relative rotation between said housing and said rotor for varying cylinder-to-cylinder fuel injection for controlling the output of said internal combustion engine.

4. The pump defined in claim 3 incorporating solenoid means associated with said valve element, and a controller having a pickup means for determining the angular position and acceleration of said rotor to effect selective and timed energization of said solenoid means to cut off the pulse fuel flowing through said porting means to thereby control the quantity of fuel fed to each of said cylinders.

* * * * *